US007524239B2

(12) United States Patent
Schmidberger-Brinek et al.

(10) Patent No.: US 7,524,239 B2
(45) Date of Patent: Apr. 28, 2009

(54) ELECTRIC HAND TOOL—IN PARTICULAR AN ANGLE SANDER/GRINDER

(75) Inventors: Susanne Schmidberger-Brinek, Roemerstein (GR); Norbert Schur, Metzingen (GR)

(73) Assignee: Metabowerke GmbH (DE)

( * ) Notice: Subject to any disclaimer, the term of this patent is extended or adjusted under 35 U.S.C. 154(b) by 0 days.

(21) Appl. No.: 11/867,148

(22) Filed: Oct. 4, 2007

(65) Prior Publication Data

US 2008/0153404 A1 Jun. 26, 2008

(30) Foreign Application Priority Data

Oct. 7, 2006 (EP) ..... 06021103

(51) Int. Cl.
*B24B 23/00* (2006.01)

(52) U.S. Cl. ..... 451/451; 451/359; 451/454

(58) Field of Classification Search ..... 451/344, 451/353, 357, 359, 451, 454
See application file for complete search history.

(56) References Cited

U.S. PATENT DOCUMENTS

| | | | | |
|---|---|---|---|---|
| 4,060,940 | A * | 12/1977 | DeWitt | 451/358 |
| 4,574,532 | A * | 3/1986 | Haberle et al. | 451/451 |
| 4,791,541 | A * | 12/1988 | Simmons | 362/376 |
| 4,924,635 | A * | 5/1990 | Rudolf et al. | 451/344 |
| 5,005,321 | A * | 4/1991 | Barth et al. | 451/359 |
| 5,384,985 | A * | 1/1995 | Jacobsson | 451/344 |
| 5,440,815 | A * | 8/1995 | Inkster | 30/390 |
| 5,766,062 | A * | 6/1998 | Edling | 451/451 |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Booeshaghi et al. | 451/451 |
| 6,988,939 | B2 * | 1/2006 | Hofmann et al. | 451/344 |
| 7,063,606 | B2 * | 6/2006 | Stierle et al. | 451/359 |
| 7,311,589 | B2 * | 12/2007 | Wiker | 451/451 |

FOREIGN PATENT DOCUMENTS

| | | | |
|---|---|---|---|
| DE | 3913898 | A1 | 10/1990 |
| DE | 10259520 | A1 | 7/2004 |
| DE | 10343060 | A1 | 4/2005 |
| EP | 0812657 | A1 | 12/1997 |

* cited by examiner

*Primary Examiner*—Eileen P. Morgan
(74) *Attorney, Agent, or Firm*—Donald R. Boys; Central Coast Patent Agency, Inc.

(57) ABSTRACT

The invention relates to an electrical hand tool device, in particular an angle grinder with a machine housing for holding a motor for the rotating drive of a drive shaft and a driven shaft connected with it via an angular gear for attaching a grinding tool at its free end, whereby a protective guard (12) that surrounds the grinding tool with a base body (14) at least partially and exhibits a protective guard neck (16) that is connected to the base body (14) and that can be detached together with said protective guard neck at a flange (20), which is positioned at the machine housing, and can be secured and locked in discrete adjustable rotational positions at the flange (20), whereby the protective guard (12) can be secured and locked at the flange (20) in a rotational position using a notch lever (18), and where for this purpose a ratchet cam (42) at the notch lever (18) reaches through an opening (40) in the protective guard (12), where a pivoting axis (22) of the notch lever (18) is arranged parallel to the driven shaft and the opening (40) is located in the protective guard neck (16) of the protective guard (12).

6 Claims, 2 Drawing Sheets

ELECTRIC HAND TOOL—IN PARTICULAR AN ANGLE SANDER/GRINDER

CROSS-REFERENCE TO RELATED DOCUMENTS

The present application claims priority to a German patent application serial number EP 06021103.4-1262 entitled "Electric Hand Tool—In Particular an Angle Sander/Grinder", which was filed on Oct. 7, 2006, which is incorporated herein in its entirety, at least by reference.

The invention relates to an electrical hand tool device, in particular to an angle grinder with a machine housing for holding a motor for the rotating drive of a drive shaft and a driven shaft connected with it via an angular gear for attaching a grinding tool at its free end, whereby a protective guard that at least partially surrounds the grinding tool with a base body and exhibits a protective guard neck that is connected to the base body and that can be detached together with said protective guard neck at a flange, which is positioned at the machine housing, and can be configured in adjustable rotational positions, whereby the protective guard can be configured and locked in a rotational position using a notch lever and where for this purpose a ratchet cam at the notch lever reaches through an opening in the protective guard.

With electrical hand tool devices, in particular angle grinders, a protective guard is often provided that has the purpose to keep the sparks or material particles that can fly off when working with rotating tools such as grinding or cutting disks away from the operator. In addition, in particular the use of the protective guard has the purpose of keeping parts away from the operator of the electrical hand tool device in case of a destruction of the grinding tool. For this purpose, it is generally provided that the protective guard covers only a limited angular range of the circular grinding tool, typically 180° of the rotating tool. As a rule, this provides sufficient protection for the various applications. However, since different applications require a different approach angle of the grinding tool, it is often desired that the protective guard is designed in an adjustable fashion with regard to its rotational position in relation to the machine housing. For example, in an idle position, the protective guard is most often designed to be symmetrical to the longitudinal axis of the housing at the side of the grinding tool that points in the direction of the machine housing. However, depending on the operating position, it may also be desired that other areas are covered, that is, typically those areas that are located diametrically opposite the current work area. In order for the operator to be able to achieve a rotation of the protective guard into the required protective position, it is advantageous for the protective guard to be adjustable without the use of tools. Only if an adjustment is uncomplicated will the protective guard be set appropriate for the respective work and provide a secure protection for the operator even when a tool bursts.

For example, DE 102 59 520 A1 discloses a respective electrical hand tool device that provides a protective guard, which has for this purpose a toothing section formed at a clamping neck of the machine housing, where a locking catch that is spring loaded in the direction of the toothed section and is located at a clamping bracket that is attached to the protective guard can engage in said toothing section. To release the locking catch, it may be provided that a hand lever is provided that is attached directly to the clamping bracket.

One respective embodiment has the disadvantage that the clamping bracket, if it is a metal bracket, first needs to be attached to the protective guard, and that it may become necessary to readjust the clamping bracket such that it is securely situated at a neck of the protective guard.

Furthermore, known from DE 103 43 060 A1, for example, is an electrical hand tool device of the generic kind, where the pivoting axis of the notch lever runs parallel to the longitudinal axis of the angle grinder and the notch lever is positioned perpendicular to the longitudinal axis of the angle grinder.

In this instance, the protective guard consists of two elements, namely a base body as well as a hat-shaped form that is connected to the base body and that reaches over the flange of the electrical hand tool device in its cylindrical section, namely the protective guard neck. In this case, the recesses for engagement are located in the brim of the hat-shaped element of the protective guard, which has the disadvantage that this area of the protective guard is under more stress, for example when the tool bursts, which may cause an involuntary loosening of the locking position.

Based on this state-of-the-art, it is the objective of the invention to provide an electrical hand tool device with a protective guard that can be attached easily to the electrical hand tool device and that provides a good protection of the operator, even when the tool bursts.

The invention solves this objective through an electrical hand tool device of the generic kind, where a pivoting axis of the notch lever is located parallel to the drive shaft and the opening is located in the protective guard neck of the protective guard. A respective arrangement produces the result that the ratchet cam reaches through the protective guard in the radial direction of the protective guard neck such that the direction of force of the notch lever runs in the radial direction as well as opposite to an axial direction with regard to the drive axis in the state-of-the-art. The result of this is that should the tool burst, the force of the tool parts breaking loose strikes the protective guard essentially perpendicular to the latching direction, which can largely avoid that an unintentional release of the rotational position of the protective guard in relation to the machine housing occurs.

In addition, an arrangement of the notch lever such that a pivoting axis is located parallel to the drive shaft offers the advantage of a particularly ergonomic pivoting capability of the protective guard. With this design, the lever can be actuated when the operator of the electrical hand tool device holds it in his hand in the typical work position without, for example, having to place the machine initially in a different position, in particular without having to turn the machine upwards with a tool in order to operate the lever without any hassle.

Providing an easy adjustment of the rotational position will lead to the operator being more inclined to make a respective adjustment. In particular, a pivoting axis parallel to the drive shaft also allows for a release of the engagement and a simultaneous rotation of the protective guard with one hand such that it is not necessary to put down the electrical hand tool device in order to place the protective guard into an additional position.

Furthermore, such a design offers manufacturing advantages because the protective guard neck must be handled to install guide elements and, therefore, the opening can be provided in the same processing step.

Designing the latch connection in the protective guard rather than in the gearbox flange is also advantageous, because as a rule it is made of a more solid material than the gearbox flange; thus, the protective guard will securely remain in its position, in case the tool bursts apart. In addition, the lever at the flange offers the advantage of an easier exchange of the protective guard and the option for a less complex design of the protective guards.

A preferred embodiment provides that the notch lever is prestressed on a neck of the flange in the radial direction. Prestressing may be done, in particular, using a spring element, whereby the spring element can be supported on the flange as well. As a result of the spring, the notch lever will always automatically return to the latching position. The notch lever can be moved by an operator against the spring force from the latching position, in which the ratchet cam reaches through the opening in the neck of the protective guard, and the protective guard can be rotated in relation to its position at the machine housing. As soon as the rotating step is initiated, the lever can be released and it will then, when reaching the next opening and thus the next discrete rotational position with regard to the machine housing engage in the next opening and in this manner secure the protective guard with regard to its position.

The spring can be inserted loosely and is secured in its position by joining the gearbox flange and the housing of the electrical hand tool device.

According to one preferred embodiment, it can also be provided that the notch lever exhibits an actuation section at its end that faces away from the pivoting axis. In this case, the actuation section can be designed at an angle from the remaining lever such that the actuation section and with it the lever can be grasped easier. In particular, the actuation section can be bent radially outward with regard to the drive shaft in order to permit easier grasping.

Furthermore, it can be provided that the ratchet cam is placed at the center between the pivoting axis and the actuation section. Such a design can provide sufficient securing of the ratchet cam in the opening and at the same time, the actuation forces can be set such that one-hand operation is made possible. Furthermore, spring-loaded securing of the ratchet cam that reaches through the opening in the protective guard enables an adjustment of a potentially occurring play of the protective guard in relation to the flange. In addition, it can be provided that the position of the notch lever as well as the shape of the ratchet cam are selected such that the ratchet cam wedges in the opening of the protective guard neck should the tool burst, thus additionally avoiding an unintentional release.

To this end, it can be provided in particular that the ratchet cam rests at a protrusion at the flange in the direction of the circumference, or particularly preferred, engages in a recess provided at the gearbox flange for this purpose. In this manner, in case of destruction, the force for securing the protective guard does not need to be absorbed by the lever alone, but can be initiated in the ratchet cam, which will then receive said protective guard.

In this case, it can be provided that the flange is attached to the machine housing in a detachable manner or connected with it in one piece, in particular molded directly onto it.

It is additionally advantageously provided that the flange exhibits a groove, which in particular is at a sufficient distance from its free end that is pointing toward the tool such that a sufficient axial distance is provided between the protective guard and the tool. The protective guard is guided in this groove and held in the axial direction. To this end, it can be provided that at the protective guard guide elements are provided that engage in the groove. Preferably, the guide elements are dimensioned smaller than the ratchet cam. For attaching the protective guard and for insertion into the groove it can be provided that this is possible in one position only through a design by which the protective guard can be coupled with the flange in the manner of a bayonet connector. To this end, grooves extending in axial direction are provided in which the guide elements are inserted when placing the protective guard onto the flange, such that the protective guard can then be slid onto the flange in the direction of the housing until the guide elements come to be in the radially extending groove where they can be rotated such that axial removal is prevented. In this case, the axial grooves are dimensioned differently and in this manner define the position during assembly.

Furthermore, it can be provided that a spring element can be attached to the flange such that the protective guard can be prestressed in the flange in the axial direction against a stop that is formed preferably by the edge of the groove. To this end, it can be provided that a spring waved in axial direction is positioned between the protective guard and the flange.

Additional advantages and features of the invention become apparent from the other application documents. Following, the invention shall be described in greater detail using a drawing, whereby FIG. 1 shows a protective guard as well as a notch lever;

Figure 1:
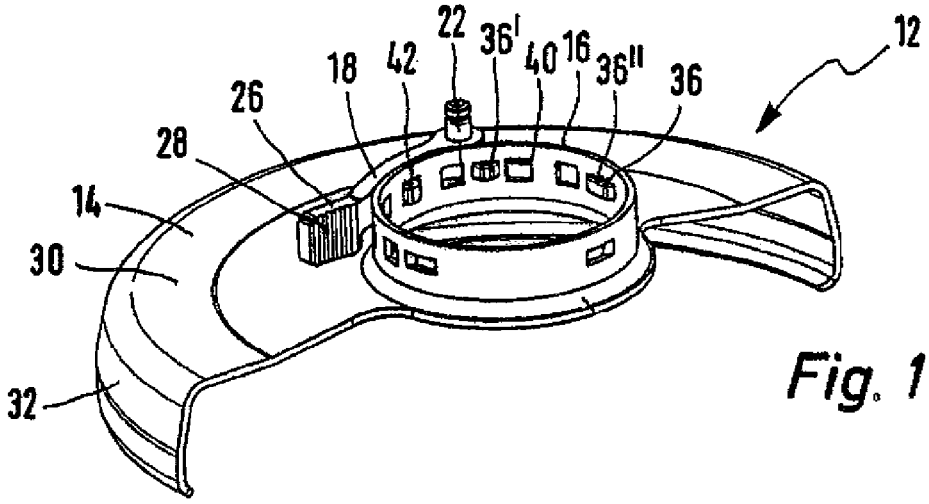

FIG. 1 shows a protective guard, which in its entirety is provided with the reference character 12. The protective guard comprises a base body 14 as well as a protective guard neck 16. The protective guard neck 16 can be connected in one piece with the base body 14 of the protective guard. As an alternative, other connection options such as gluing, riveting, welding or soldering are possible. It can be provided that the base body 14 is made of a different material than the protective guard neck 16. In this manner, the two parts of the protective guard 12 can be dimensioned optimally with regard to their strength.

Figure 2:
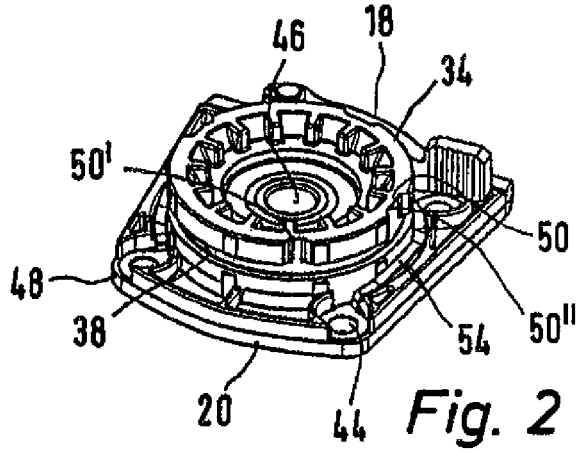
FIG. 2 shows a flange of an electrical hand tool device with a notch lever arranged on it.

In addition, FIG. 1 shows a notch lever 18, which, as can be seen in FIG. 2, can be secured on a flange 20 of an electrical hand tool device. For better recognition of the individual elements, the flange 20 itself is omitted in FIG. 1. The notch lever 18 is pivoted around an axis 22, which extends parallel to the axis of a drive shaft, whose axis has the designation 24 in FIG. 4. An actuation section 26 is provided at the free end of the notch lever 18, which faces away from the pivoting axis 22, where the operator of a respective electrical hand tool reaches to actuate the notch lever 18. For better stability, the actuation section 26 can be provided here with a profile 28 to prevent slipping off from the notch lever 18.

The base body 14 of the protective guard 12 has a pot-shaped design with a bottom section 30 arranged parallel to a tool, in particular a grinding or cutting disk, as well as an essentially cylindrical section 32 that is directed around the tool. In this case, the base body 14 of the protective guard 12 covers essentially 180° of a respective tool.

In this case, the protective guard neck 16 is used for securing at the flange 20 by reaching there, across a respective cylindrical section 34. Essentially, the protective guard neck has a cylindrical shape with guide elements 36 being located on the inside of the protective guard neck 16, where said guide elements serve the purpose of guiding the protective guard at the cylindrical section 34 of the flange in a rotating manner and in the assembled state engage in a groove 38, thus preventing an axial separation of the protective guard 12 from the flange 20. In addition, the protective guard neck 16 features openings 40, which essentially can be arranged across a part of the circumference or across the entire circumference of the protective guard and are used for securing and controlling the discrete rotational positions of the protective guard 12 with regard to an electrical hand tool device. The ratchet cam 42 reaches through an opening 40 of the protective guard neck and in this manner secures the rotational position of the protective guard 12 relative to the flange. In this case, the ratchet cam is molded in one piece to the notch lever 18 and is designed such that under load it wedges in the opening 40.

Through the distribution of the openings 40 across the circumference of the protective guard neck 16, a specified number of positions of the protective guard can be assumed.

FIG. 2 now shows the flange 20 that can be secured to a not shown machine housing of an electrical hand tool device using screw connections (not shown) that reach through the opening 44 in the flange. The flange exhibits a central opening 46 with the driven shaft of the electrical hand tool device, which is not shown as well, reaching through said opening. In addition to the cylindrical section 34, the flange comprises a flange plate 48 that essentially is used for mounting to the electrical hand tool device.

At its outer circumference, the cylindrical section 34 of the flange 20 features axial grooves 50 in which the guide elements 36 are inserted when axially placing the protective guard 12. In this case, the guides have different sizes, with FIG. 1 showing guide elements 36' and 36". Accordingly, designed grooves 50' and 50" correspond to said guide elements such that a placement of the protective guard and a joining in axial direction is possible only in a certain specified position. As soon as the protective guard 12 is then placed onto the cylindrical section 34 of the flange 20 to an extent that the guide elements 36 come to be in the area of the radial groove 38, the protective guard can be rotated, whereby the guide elements 36 are guided in the radial groove and in this manner can avoid an axial removal of the protective guard 12.

Furthermore, FIG. 2 shows the notch lever 18, which after placing the protective guard 12 reaches with its not recognizable ratchet cam 42 into an opening 40 in the protective guard, and in this manner locks the protective guard 12 in a rotational position.

Figure 3:
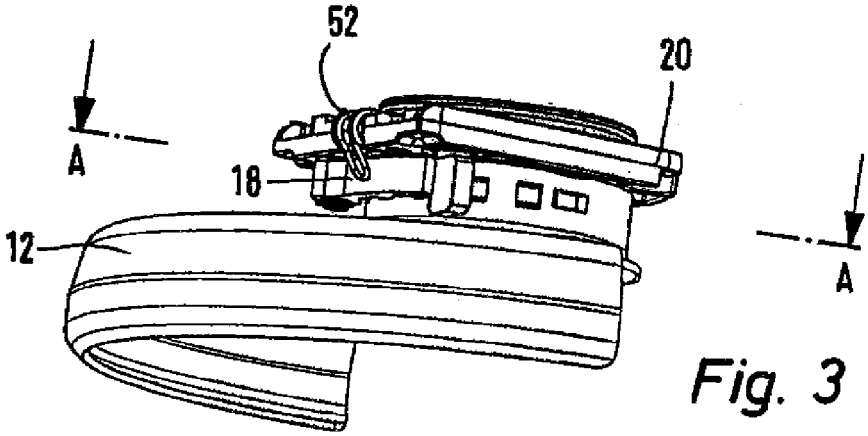
FIG. 3 is a perspective presentation of the protective guard arranged at the flange.

FIG. 3 shows an assembled position, where the protective guard 12 is secured on the flange 20. In this case, the notch lever 18 is prestressed in the latching position via a spring 52, in order to avoid an unintentional loosening of the ratchet cam from the opening even with vibrations during the operation of the electrical hand tool device.

Figure 4:
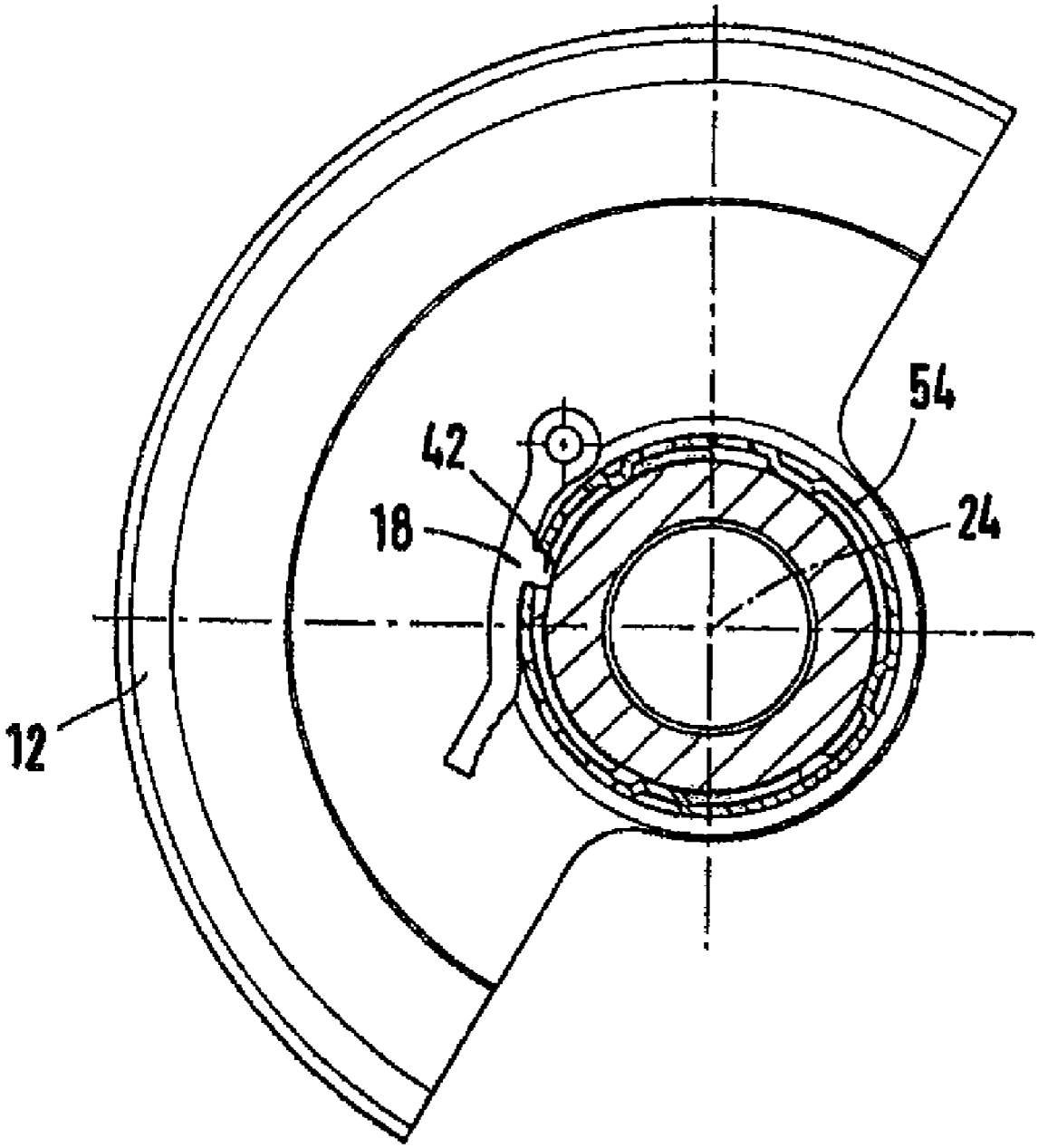
FIG. 4 is a section along the line A-A in FIG. 3.

FIG. 4 shows a section along the line A-A, where the engagement of the ratchet cam 42 can be recognized through an opening 40 in the protective guard 12 and where in the latched position, the ratchet cam 42 rests against the cylindrical section 34 of the flange 20. In addition, FIG. 4 shows an additional mechanism for reducing the play between the protective guard 12 and the flange 20. To this end, a spring 54 is positioned between the two elements, with said spring have a wave shape in the axial direction and in this manner corrects the play between the flange 20 and the protective guard 12. The spring 52, which places the notch lever 18 against the protective guard 12 and the flange, also provides a play correction in the radial direction.

Furthermore, a respective design offers, in addition to the simple pivoting capability of the protective guard, even in a one-hand operation, the advantage that the protective guard can be separated from the flange 20 only through several hand movements, such that the probability of a removal of the protective guard by the operator is reduced.

Even if the tool bursts, a respective design offers that the preset rotational position is securely retained, thus protecting the operator of the electrical hand tool device.

Furthermore, existing accessories can be used, and in particular, a subsequent attachment to typical flanges of electrical hand tool devices of the generic kind is possible.

The invention claimed is:

1. An electrical hand tool having a rotatably adjustable guard assembly, the guard assembly comprising:

a flange assembly comprising:

a cylindrical flange neck having an axis and an outside diameter, the neck extending perpendicular to a planar region, the planar region configured to fasten to a body of a hand-held rotary tool, such that the flange neck is axially concentric with a shaft for driving a disk-shaped cuffing or grinding element; and a cam lever pivoted from the planar region at a point outside the outside diameter of the flange neck along a pivot axis parallel to the axis of the flange neck, the cam lever having a free end and a cam extension toward the flange neck at a point between the free end and the pivot, the cam lever urged by a spring element to urge the cam extension against the outside diameter of the flange neck; and a guard, comprising:

a housing configured to enclose a portion of the disk-shaped cuffing or grinding element, the housing including a substantially planar section coplanar with the planar region of the flange assembly; and a cylindrical guard neck extending perpendicular to the substantially planar section, the guard neck having an inside diameter slightly larger than the outside diameter of the flange neck and an outside diameter small enough to clear the pivot end of the earn lever with the guard neck engaged over the flange neck, the guard neck further comprising a plurality of openings arranged around the circumference of the guard neck;

wherein, with the guard neck engaged over the flange neck the guard is held rotationally in one position by the cam extension contacting the outside diameter of the flange neck though one of the plurality of openings in the guard neck, and the rotational position of the guard may be changed by lifting the cam lever against the spring, rotating the guard to a new position and releasing the cam lever to urge the cam extension through a different opening in the circumference of the flange neck.

2. The hand tool of claim 1 wherein the cam lever comprises an actuation section for a user's fingers at the free end.

3. The hand tool of claim 1 wherein the flange neck has one or both of protrusions or recesses for receiving the cam extension of the cam lever.

4. The hand tool of claim 1 wherein the planar region of the flange assembly has openings in a pattern for fasteners to engage elements in a matching pattern in the body of the hand-held rotary tool.

5. The hand tool of claim 1 wherein the planar region of the flange assembly is integral with the body of the hand-held rotary tool.

6. The hand tool of claim 1 wherein the outside diameter of the flange neck has a radial groove engaging extensive elements of the inside diameter of the guard neck s a retentive mechanism.

* * * * *